US007182023B2

(12) United States Patent
Wu et al.

(10) Patent No.: US 7,182,023 B2
(45) Date of Patent: Feb. 27, 2007

(54) TRACK STRUCTURE OF THE RAPID TRACK TRANSIT

(75) Inventors: Xiangming Wu, Shanghai (CN); Zhong Wu, Shanghai (CN)

(73) Assignee: Shanghai Maglev Transportation Development Co., Ltd., Shanghai (CN)

( * ) Notice: Subject to any disclaimer, the term of this patent is extended or adjusted under 35 U.S.C. 154(b) by 0 days.

(21) Appl. No.: 10/488,700

(22) PCT Filed: Jul. 1, 2002

(86) PCT No.: PCT/CN02/00465

§ 371 (c)(1),
(2), (4) Date: Mar. 5, 2004

(87) PCT Pub. No.: WO03/025285

PCT Pub. Date: Mar. 27, 2003

(65) Prior Publication Data

US 2004/0221761 A1 Nov. 11, 2004

(30) Foreign Application Priority Data

Sep. 21, 2001 (CN) ..... 01 1 26832

(51) Int. Cl.
*B61B 13/04* (2006.01)
*E01B 3/00* (2006.01)

(52) U.S. Cl. ..... 104/118; 238/115

(58) Field of Classification Search ..... 104/118, 104/119, 120, 124; 238/115, 109
See application file for complete search history.

(56) References Cited

U.S. PATENT DOCUMENTS 5,850,794 A * 12/1998 Raschbichler et al. ..... 104/281
6,554,199 B1 * 4/2003 Flessner et al. ..... 238/115
6,571,717 B2 * 6/2003 Svensson ..... 104/125

FOREIGN PATENT DOCUMENTS

EP 0433170 A1 12/1990
EP 1048784 A2 11/2000

* cited by examiner

*Primary Examiner*—S. Joseph Morano
*Assistant Examiner*—Robert J. McCarry, Jr.
(74) *Attorney, Agent, or Firm*—Rabin & Berdo, P.C.

(57) ABSTRACT

A guideway structure for the high-speed track-bound transportation is composed of the lower-layer main load-bearing girders and the guideway-surface structure elements. The structural elements are connected by the steel elements at the functional zones and the reinforced concrete plates on the guideway body to form an integral. The invention is one of the guideway structures especially suitable for the guideway structure across a river of medium- or small-width.

6 Claims, 5 Drawing Sheets

TRACK STRUCTURE OF THE RAPID TRACK TRANSIT

FIELD OF THE INVENTION

The invention generally relates to a guideway structure for high-speed track-bound transportation and especially relates to a guideway structure suitable to the running of magnetic levitation (maglev) train. The guideway structure is composed of main load-bearing girders (steel structure girder or pretressed concrete girder, reinforced concrete girder and etc.) and guideway-surface structure (reinforced concrete plate girder).

BACKGROUND OF THE INVENTION

Magnetic levitation train is a high-speed carrier system. An extremely high accuracy supporting structure, i.e. guideway structure, is required when the train is running with high-speed. Firstly, for the force-bearing characteristics of the guideway structure, the deformation and the deflection of the guideway structure must be controlled within a very small range under the action of train dynamic load as well as under the influence of external environment, such as the influence of temperature variation, wind force action and etc., at the same time the dynamical characteristics of guideway structure must also be strictly controlled, the magnetic levitation train requires the first-order frequency of free vibration of the guideway structure must be greater than 1.1 times the ratio of train running speed to guideway structure span. Secondly, the running systems for magnetic levitation train also requires the functional zones of the guideway structure having extremely strict accuracies; the functional zones are at both sides of the top portion of guideway structure, inclusive of top sliding surface, gliding surface at both sides and bottom stator pack surface. The accuracies of all the above three function surfaces are required to be 1 mm or within 1 mm (0.4 mm). The above guideway structural requirement for the magnetic levitation train system determines that the guideway structure for magnetic levitation train differs greatly from that of the conventional railway bridge and track of ordinary low-speed and medium-speed carrier system.

It is known by structural calculation and analysis that in comparing it with conventional railway structure, the structure rigidity of guideway, which is able to satisfy the technical requirement for the running of magnetic levitation train, will increase a lot. Therefore classifying the guideway structure according to materials used for it, no matter steel structure or prestressed concrete structure or the reinforced concrete structure is adopted, the height, the width and the section dimensions of guideway structure must be increased greatly. The weight of magnetic levitation structure will also increase synchronously. Classifying the guideway structure according to construction system, there are two main modes of guideway construction, namely the monolithic construction and the layer construction mode. In monolithic construction mode, i.e. in an integration of the load-bearing structure and track-surface structure, according to the fabrication and connection style the monolithic construction mode of track and girder may be further classified into two cases. In the first case the track-surface functional zones and girder body are fabricated and processed as an integration structure and in the second case they are fabricated and processed individually and then connected together to be an integration structure. After the steel structure of functional zones and the main load-bearing girder of the former are integrally fabricated and processed, advanced six-axis NC (Numerical Control) boring-milling machine tool is used for integral machining of the top gliding surface, the lateral guiding surface and the connecting slot of steel girder for fixing stator packs are machined with the advanced six-axis NC (Numerical Control) boring-milling machine tool, finally the stator packs are installed. In the latter case the steel structure of functional zones, the function surfaces and etc. are fabricated and machined individually, the main load-bearing girder, pre-embedded elements and the connecting surface of the connecting elements are machined integrally under condition of an integral girder body, finally the steel structure of functional zones and the main load-bearing girder are connected as an integration after the machining work is completed. In both cases of above construction mode, the machining work of a whole girder is unavoidable. It is known from the material, construction composition, fabrication and machining of monolithic construction mode that although such a construction mode may provide a good integrity and a great structure rigidity, yet there is very high requirement for the general layout of the girder factory, the fabrication of formwork and the equipment of machine tools. The arrangement of the girder fabricating workshop must satisfy the requirement for a many of working procedures able to be orderly carried out at same time and a large thermostatic workshop is demanded for the machining work of a whole guideway girder. In case that the pre-stressed concrete hybrid girder is adopted, the formwork must have sufficient rigidity, enough to ensure the pre-embedded elements to be disposed respectively at accurate positions and the machine tool must be with six-axis numerical control ability. Thus high technical contents of equipment and a big investment are required. Therefore, a big engineering quantity is required because the supporting platform for machining the whole girder must basically be without any deformation. As for the layer construction mode, the load-bearing structure and the guideway-surface structure are fabricated separately, arranged layer by layer, and then connected to form a guideway structure by means of supporting structures.

Such a layer construction is also called a special construction. Its lower-layer is a conventional bridge structure system, its upper-layer is a wide guideway-surface structure of 6.192 meters long and 2.8 meters wide. The construction is composed of the body structure reinforced concrete plate girder and the top sliding steel plate and the guiding steel plate at the side of functional zone, side guiding steel plate as well as the bracket for fixing stator packs. Three reinforced concrete supporting posts are used for supporting the guideway surface and the lower-layer structure. The supporting posts are connected with the upper-layer structure with cement mortar bed poured on-site and fastened with steel screw rods. In case that the lower-layer structure is a concrete structure, the supporting posts may be directly connected with the lower-layer structure. Two of these three posts respectively at each of the external sides are with necking at the bottom portion thereof in order to achieve an effect of binge jointing. The main drawbacks of the structure are as follows:

1. When the steel structure of functional zones and the reinforced concrete plate girder are as a monolithic construction to be fabricated, shrinkage gaps are liable to occur at the connecting surface between two different kinds of material with different material properties, and the fatigue cracks will easily occur to shorten the service life of guideway structure.

2. The connection mode of the upper-layer and the lower-layer structure is unreliable. Hinge-crack caused by longitudinal expansion and longitudinal contraction due to temperature variation may occur at the bottom of the fore and the aft supporting post. Repeated load actions will make the crack to be developed and the reinforcing bar in hinge joint to be damaged and reduce the safety of the structure. Furthermore, in the case that the tie rods are used for the connection between concrete plate girder and posts, the circumstances of applied force are undefined, then the force applied on the cement mortar bed is complex. Thus the connection between the concrete plate girder and the posts is easily damaged when the longitudinal, the lateral and the vertical load act at same time, it will imperil the safety of the structure.

3. The adjustability of such supporting mode is poor because a part of the tie rod, which is used as the connection between the concrete plate girder and the posts, had been poured into the concrete plate girder and firmly cohered together with the concrete plate girder. In the position adjustment of the concrete plate girder of guideway-surface structure, a part of cement of the structure have to be chiseled away, so that it is more difficult in construction process and poorer in operating ability.

4. For the lateral rigidity of lower-layer structure is small, the lateral dimensions of the lower-layer structure have to be designed with a very large size in order to satisfy the dynamic characteristics requirement of the system.

CONTENTS OF THE INVENTION

The technical problem to be solved by the invention is to overcome the said deficiencies of the prior art and then to provide a guideway structure suitable for the magnetic levitation and other modem high-speed track-bound transportation. The provided guideway structure must be easier in fabrication and installation, reliable in the connection between the upper-layer and the lower-layer structure, and adjustable in a certain degree.

Technical solution of the invention is:

A guideway structure for high-speed track-bound transportation is composed of the lower-layer main load-bearing girder and the upper-layer track surface structure. The track surface structure is a monolithic construction formed by connecting the steel structural elements of functional zones with the reinforced concrete plate girder of guideway body by means of connecting elements. The structure is characteristic of the following:

(1) The said reinforced plate girder is an element of small-size type. Many of the reinforced plate girders are longitudinally installed along guideway line on the lower-layer main load-bearing girder by connection-mechanism; between two adjacent reinforced plate girders is reserved a certain gap for expansion and contraction of girders;

(2) In the case of the parallel double-track guideway, between the lateral surfaces of both lower-layer main load-bearing girders are disposed a series of supporting transversal girders with certain spacing along guideway line;

(3) The said connection-mechanism is composed of supporting steel girders, welding nails, high strength bolts and steel bearing plates. The supporting steel girders are connected respectively with the lower-layer main load-bearing girders by high strength bolts, steel bearing plates and connecting steel plates. The said welding nails on the top of the supporting steel girder are deeply inserted into their respective post-poured hole of the reinforced concrete plate girder. The connection will be completed by concrete-pouring on site after the reinforced concrete plate girder has been accurately positioned.

Each of the said reinforced concrete plate girders is supported by several supporting steel girders, namely at the longitudinal intermediate portion are disposed the rigid supporting steel girders and at each end the flexible supporting steel girder.

The said rigid supporting steel girder has several pieces of longitudinal stiffening plates.

On the said flexible supporting steel girder is disposed the web plate.

The lower-layer main load-bearing girder may be of girder type structure or arch type structure.

At the lateral surface of the main load-bearing girder is disposed the supporting transversal girder.

At both sides of the respective lower-layer main load-bearing girder are disposed the cable supporting brackets and maintenance walkways.

The technical effects of the invention are as follows:

1. The layer construction mode of guideway structure is used in the invention. The main load-bearing girder is separated from the track-surface structure, it may be fabricated according to the accuracy requirement of the structure of conventional municipal engineering or the structure of conventional railway track. The track-surface structure, which has to be with very high accuracy and is separated from the main body of the structure, uses the minimized structural elements, thus the fabrication and machining will be greatly simplified. These minimized structural elements may be fabricated and machined with the conventional boring and milling machine tool, and do not need any heavy duty machining equipments. As for the large-scale maglev project, the investment can be saved, the fabrication progress also be quickened. The rigid and the flexible supporting mode may be combined for the utilization of the lower-layer and the upper-layer structure so as to achieve an effect that the load may be transferred between these two structures and the deformation may be accommodated to the temperature variation.

2. When the structure of the invention is in the case of double-track guideway, the lower-layer main load-bearing girders of their respective guideways are connected by supporting transversal girders disposed between the lateral surfaces of the said girders and with certain spacing along the direction of the guideway. Thus the lateral rigidity of the guideway structure may be greatly increased without enlarging its lateral dimensions and can satisfy the requirement of lateral rigidity for the train system.

3. The track-surface structure is divided into two parts. It means that the steel structure of functional zones and the reinforced concrete plate girders of the guideway body may be fabricated and processed individually, then they are connected together by connecting elements and high strength bolts to be a monolithic construction. A majority of the problems about second-order internal force and the internal force re-distribution of the integral structure, which are caused by the contraction and the creep of concrete, may be eliminated by such an arrangement mode of the guideway structure.

4. Between the track-surface structure and the lower-layer main load-bearing girder is the steel structure connection. The steel structure may be connected with lower-layer structure by high strength bolts. The welded shear-resisting (tension-resisting) welding nails are welded on the top of the steel structure. The holes poured in-situ are preserved on the plate girder of upper-layer track-surface structure. The connection will be completed by concrete-pouring in-situ after the plate girder has been accurately positioned. This connection mode is concise and the status of applied forces is definite. Furthermore, the position adjustment of the track-surface structure may be done as follows: loosening the high strength bolts, adjusting the plate girder to an accurate position, replacing the bearing plate and finally re-tightening the high strength bolts.

5. In the arrangement of the sectional construction of the invention, the track-surface structure, the cable supporting brackets and the maintenance walkway are arranged in different layers, namely the track-surface structure is arranged at upper layer and the walkway for maintenance and etc. are arranged at the second layer. The pre-requisite of the layer arrangement mainly is based on the strict requirement of the maglev train on the dynamic characteristics of the guideway structure. For satisfying the requirement of the dynamic characteristics, the load-bearing structure must have a great rigidity and the structure is positioned high. But in case that the track-surface structure and etc are arranged in different layers, the width of the load-bearing structure may be controlled within the range of the train clearance and no any requirement in height is needed for the supporting structure of the track-surface structure plate girder, thus a supporting system with small height may be used. Therefore in both aspects of the construction height and the delimitation, the layer arrangement in sectional construction of the invention is a more ideal construction mode for the small-span and medium-span load-bearing structure (such as a bridge across a medium-width or small-width river).

BRIEF DESCRIPTION OF THE APPENDED DRAWINGS

1—main load-bearing girder;
11—supporting transversal girder;
12—cable supporting bracket;
13—maintenance walkway;
2—upper track-surface structure;
20—expansion gap;
21—reinforced concrete plate girder;
22—console (bracket);
23—steel elements of functional zone;
24—post-poured holes;
3—connection-mechanisms;
31—supporting steel girder;
311—rigid supporting steel girder;
3111—stiffening plate;
312—flexible supporting steel girder;
3121—web plate;
32—weld nail;
33—high-strength bolt;
34—steel bearing plate;
35—connecting steel plate;
36—gap of height;
37—nut socket.

DESCRIPTION OF THE EMBODIMENTS

Figure 1:
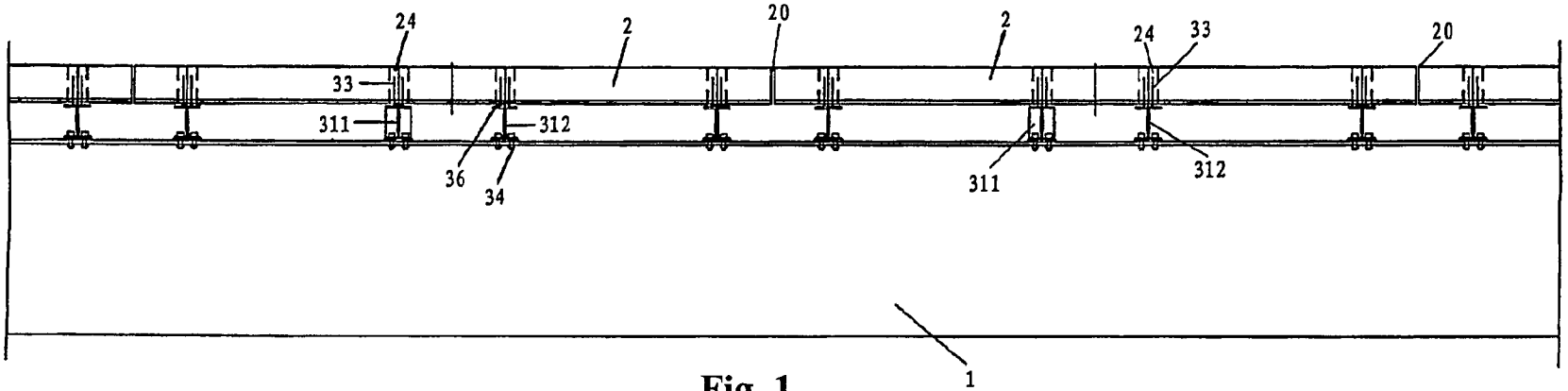
FIG. 1 is a schematic elevation diagram of the arrangement of double-layer track structure.
Figure 2:
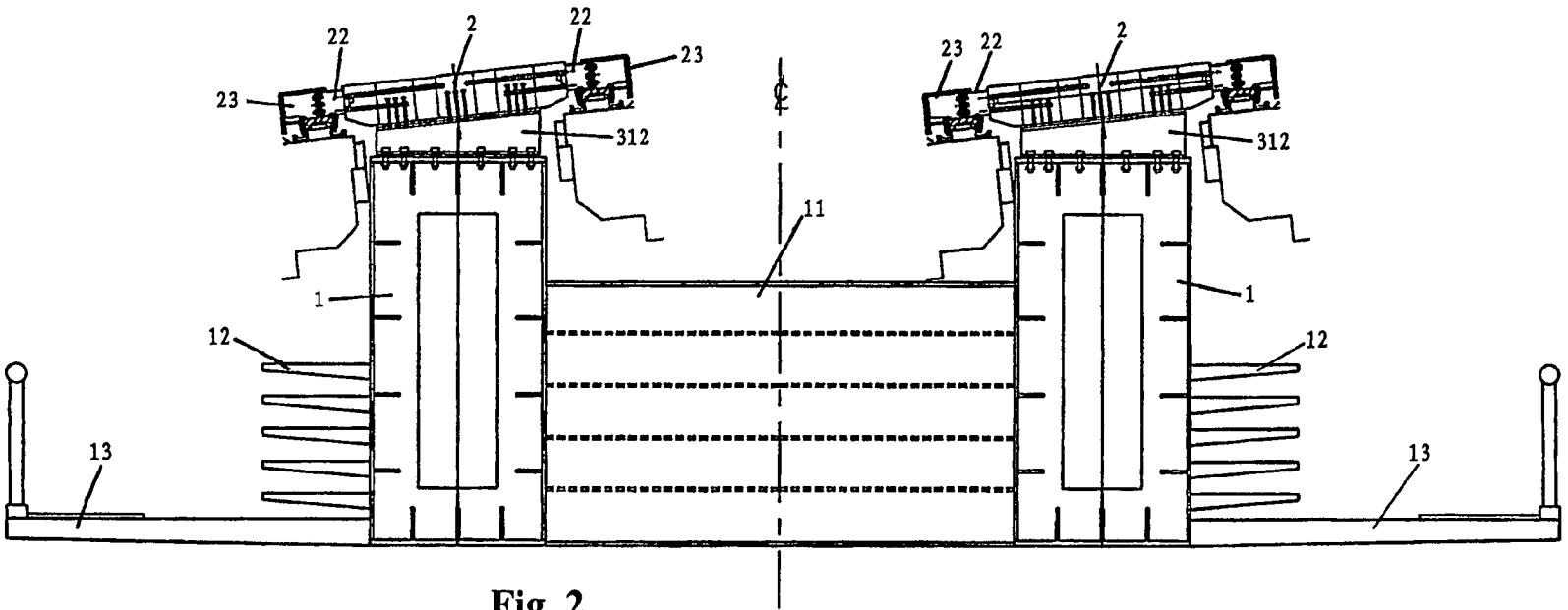
FIG. 2 is a schematic diagram of the sectional construction of double-layer track structure (including its appendages).

FIG. 1 shows the general arrangement of a double-layer guideway structure as an embodiment of the invention. Seen from the elevation view, the upper-layer track-surface structure of reinforced concrete plate girder 21 (hereinafter called element 21, if not specially specified) is connected with the lower-layer main load-bearing girder 1 by a connection-mechanism 3. The element 21 is of small-size type, its length is one or two times of that of a single functional module length (3.096 m). On the lower-layer supporting structure are many longitudinally disposed elements 21 along the direction of the guideway line. Between two adjacent elements 21 is reserved a gap 20 of a certain width for lateral loading bearing deformation and expansion and contraction due to temperature variation. The adoption of relatively small dimensions for the element 21 aims at reducing the difficulties in the fabrication and machining of the upper-layer track-surface structure. Since the weight of a single element 21 is light, the requirement on the relevant equipment used for in-situ installation and positioning may be lowered, thus the construction process of the whole guideway line may be developed simultaneously and the construction progress may be quickened. In the meantime, the minimization of the dimensions of element 21 is propitious to the decrease of longitudinal expansion and contraction deformation due to temperature variation, and the connection-mechanism for supporting can be simplified. FIG. 2 shows the transversal arrangement of the track-surface structure. After the fabrication and the machining of the steel elements 23 of the track-surface functional zones and the installation of stator packs are completed, the steel elements 23 can be connected with their respective connecting elements (consoles) 22 of the element 21 to form a monolithic structure. The consoles 22 are pre-embedded during the pouring of the elements 21 in-situ.

Figure 3:
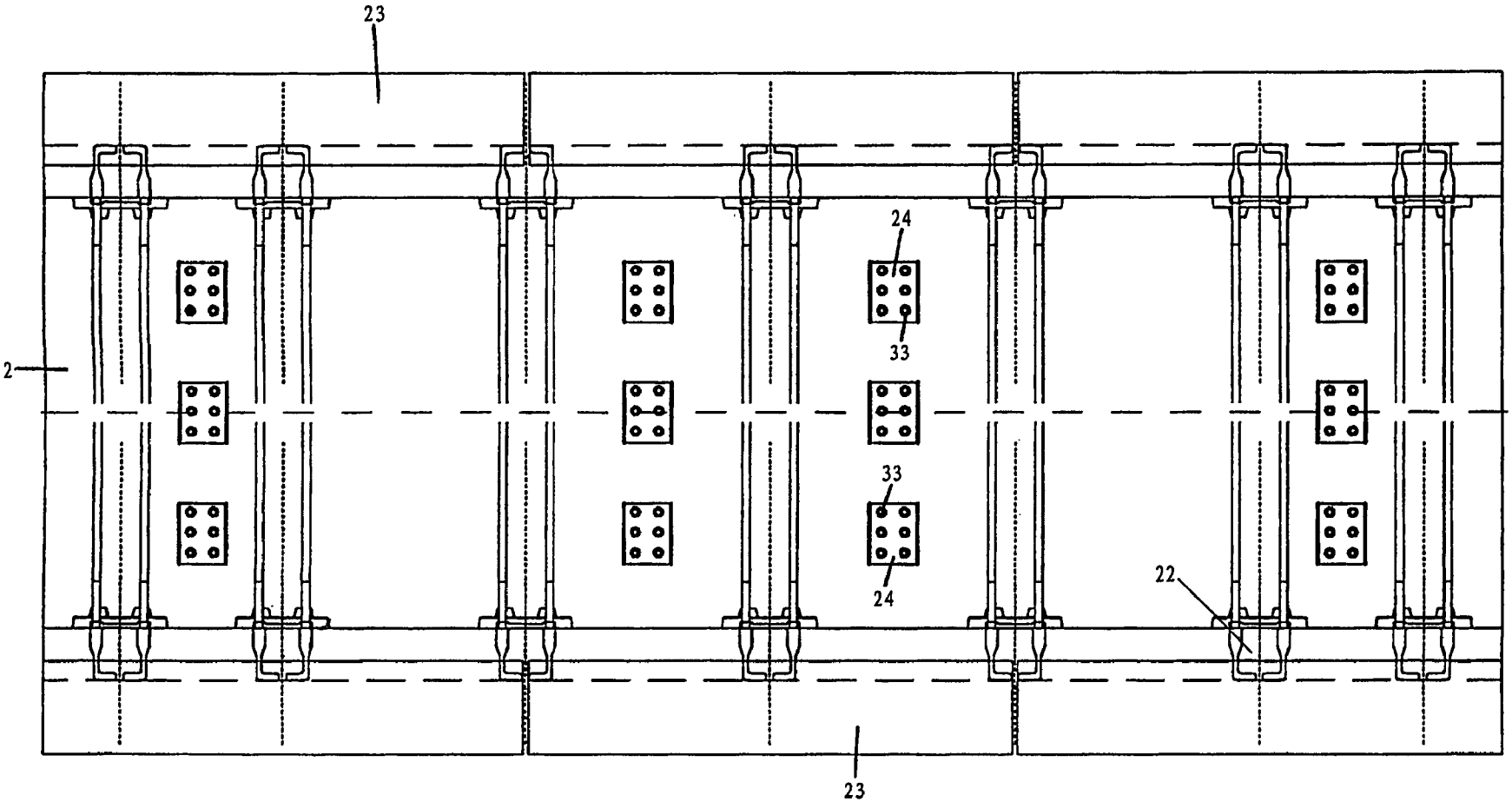
FIG. 3 is a schematic plan of the upper-layer track-surface structure.
Figure 4:
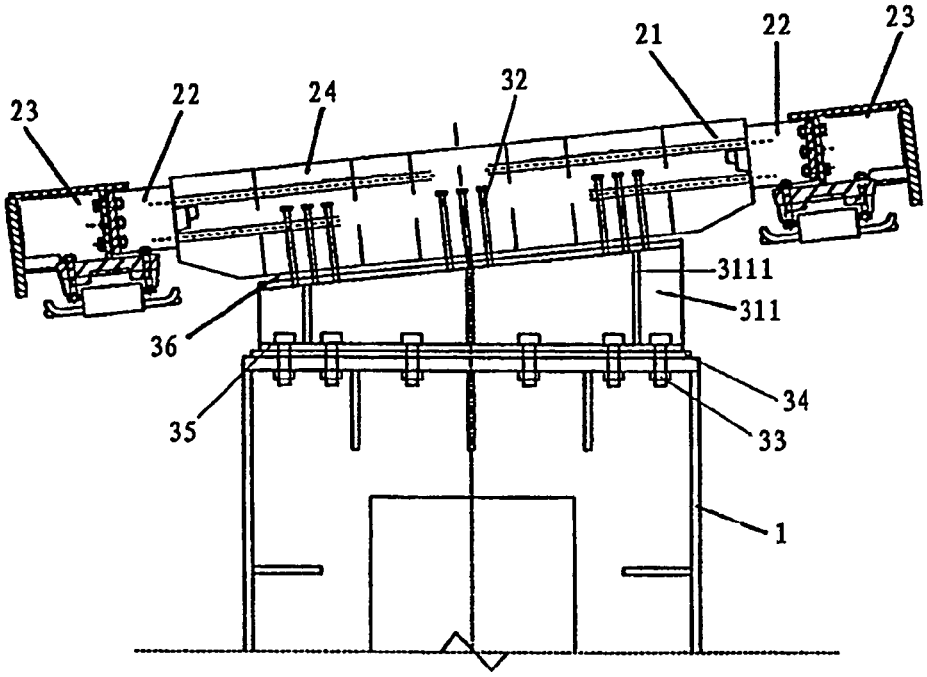
FIG. 4 shows one of the connection-mechanisms of the upper and the lower structure (including rigid supporting steel girders).
Figure 5:
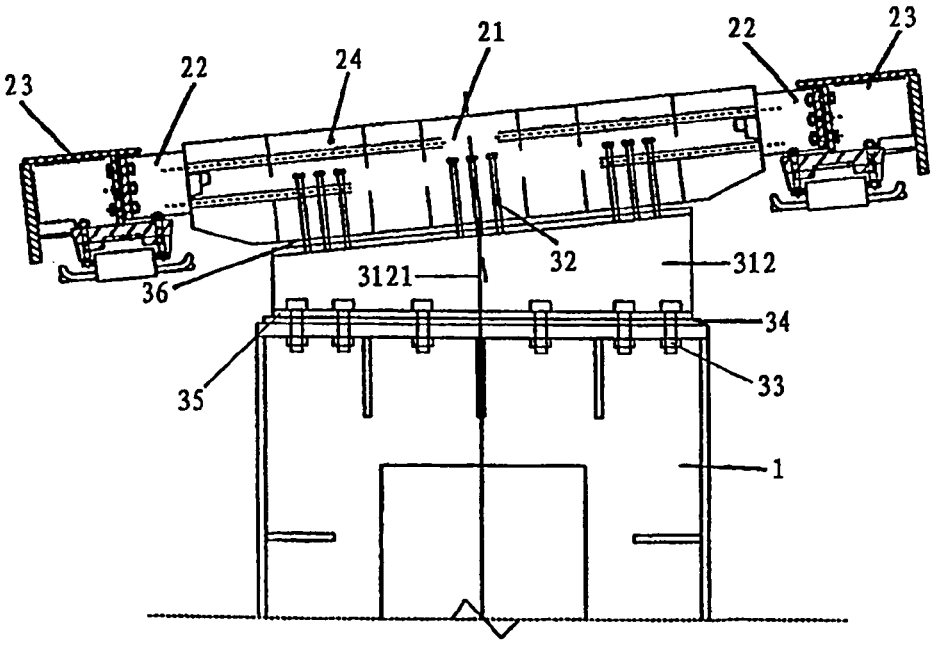
FIG. 5 shows the other connection-mechanism of the upper and the lower structure (including flexible supporting steel girders).
Figure 6:
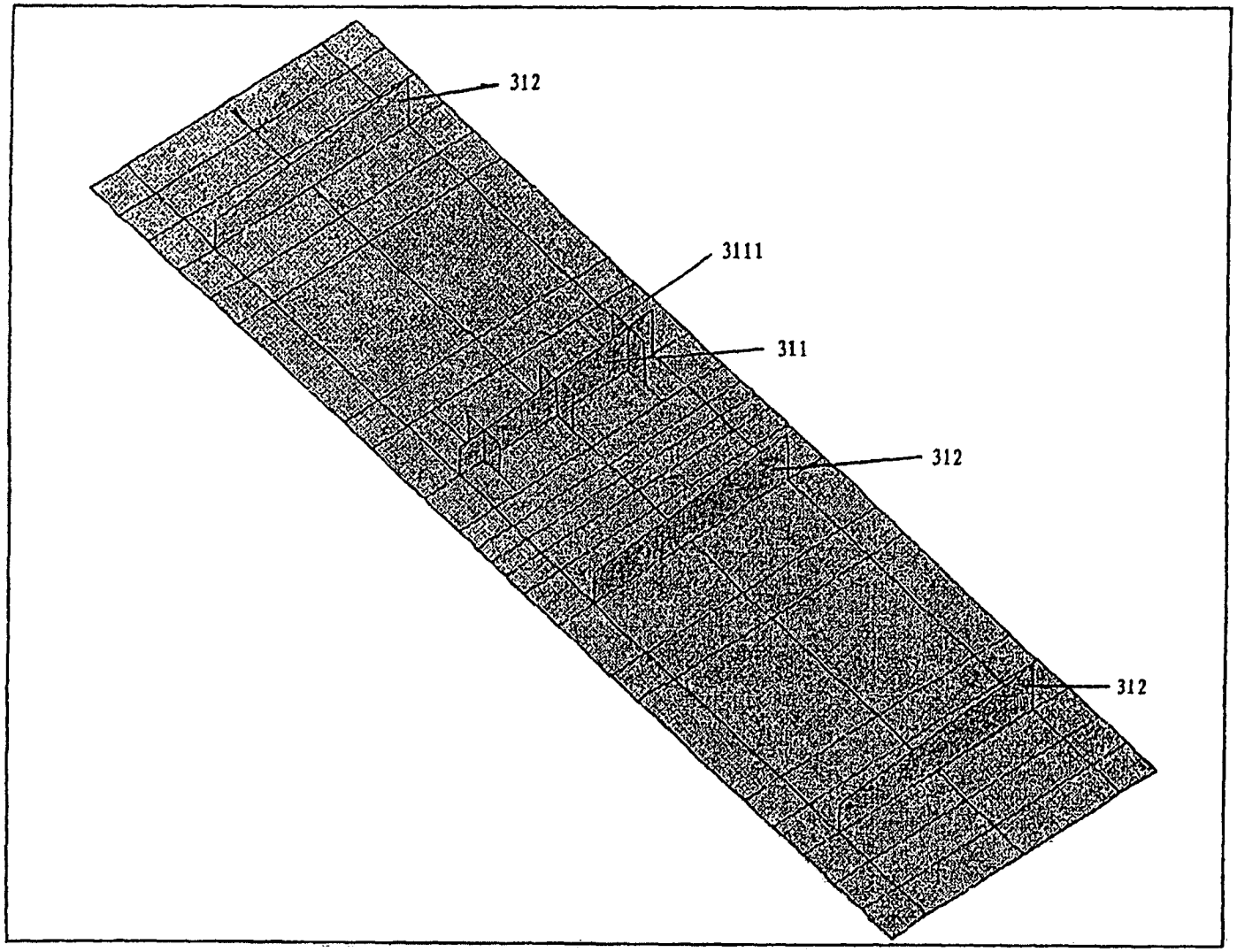
FIG. 6 is a local perspective view of the connection-mechanism.

FIGS. 4 and 5 respectively show a schematic diagram of the transversal construction of the connection-mechanism for the upper-layer and the lower-layer structures. Each connection-mechanism 3 is mainly composed of the supporting steel girder 311 or 312, weld nail 32 for fixing, high strength bolt 33 and steel bearing plate 34. From the elevation diagram of FIG. 1 it can be seen that the element 21 is supported by several steel girders. At the longitudinal intermediate portion of the element 21 is disposed a rigid supporting steel girder 311 (see FIG. 4), and at both sides of the element 21 is a flexible supporting steel girder 312 (see FIG. 5). The steel girder 311 can bear the longitudinal and the transversal dynamic load, the girder 312 can bear the transversal dynamic load, the longitudinal deformation due to temperature variation is settled by the web plate 3121 of the steel girder 312. The longitudinal rigidity of the steel girder 311 is mainly provided by the longitudinal stiffening plates 3111. The steel girder 312 has not any longitudinal stiffening plates, so that its longitudinal rigidity is less than that of the steel girder 311. The arrangement of the web plate 3121 and the stiffening plates 3111 of the steel girders 311 and 312 may be seen from FIGS. 1, 4, 5 and 6. As shown in FIG. 4, the element 21 of upper-layer track-surface structure is connected with the steel girders 311 and 312 by weld nails 32 which are welded on the steel girders 311 and 312. As shown in FIG. 3, at the upper side of the steel girders in the element 21 are disposed the post-poured holes 24, the weld nails 32 are respectively inserted therein, the connection will be completed by pouring concrete on-site after the element 21 has been accurately positioned. Between element 21 and the steel girders 311 and 312 respectively is a preserved gap with certain width to be used for adjusting the construction processing error of the main load-bearing girder 1 and the dimensional deviation of the element 21 during the positioning of the element 21. The connection respectively between lower-layer main load-beanng girder 1 and the supporting steel girder 311 as well as the supporting steel girder 312 may use the high strength bolts and the steel bearing plates 34 inserted therein. If the shift of the guideway position exceeds the allowable value after the guideway structure operates for a time, it may be adjusted to the accurate position by the replacement of the bearing plates of different thickness. The supporting steel girders 311 and 312 may be previously connected with the load-bearing structure before fabricating and installing the load-bearing structure, and then the element 21 is installed. The adjustment device for positioning and the temporary supporting devices are disposed on the top surface of the main load-bearing girder 1.

Figure 7:
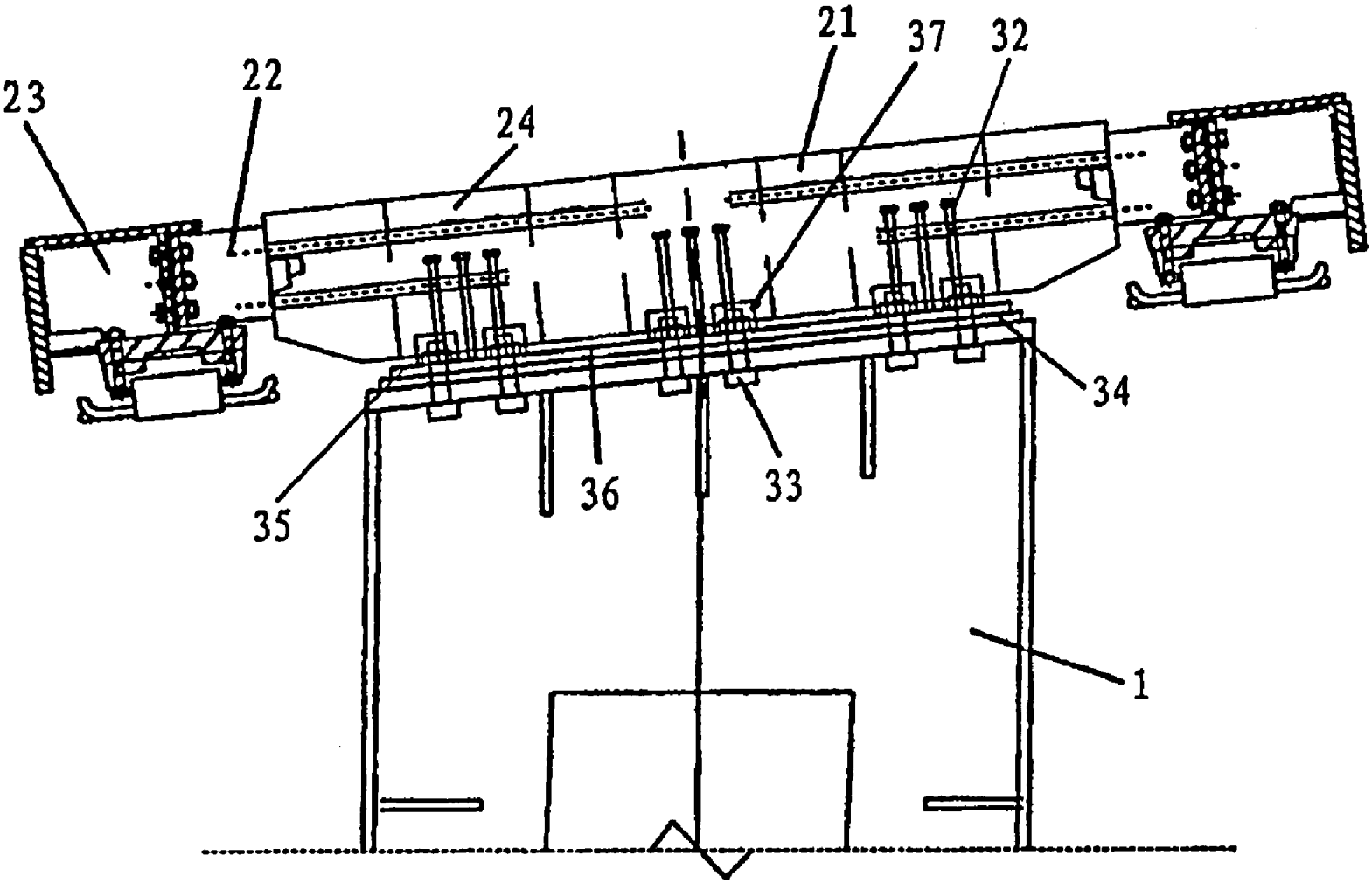
FIG. 7 is the third connection-mechanism of the upper and the lower structure.

As shown in FIG. 7 is another mode of the connection-mechanism 3 of the upper-layer and the lower-layer structure. The connection-mechanism 3 is composed of the connecting steel plates 35, the steel bearing plates 34, weld nails 32, the high strength bolts 33 and nut sockets 37. The connection between the weld nail 32 and connecting plate 35 is by welding, the function of the gap 36 and steel bearing plate 14 are the same as the previous plan (shown in FIGS. 4 and 5). The connecting plates 35 are connected with the main load-bearing girder 1 by high strength bolts. The nuts are fixed by welding on the surface of the connecting steel plate 35. The nut sockets 37 are hermitically connected with the connecting plate 35, the strength of this connection must satisfy the requirement of not any mortar-leakage in the period of pouring concrete for element 21. This connection mode is different from those as shown in FIGS. 4 and 5. In the region of the element 21 many rows of weld nails are longitudinally disposed in order to overcome the shearing force between the element 21 and girder 1 caused by temperature variation.

In the case that the upper-layer and the lower-layer structure are connected by steel girders 311 and 312 or by the connecting steel plate 35, according to the construction mode and the material used, the weld nails 32 may be substituted by other shear-resisting elements such as the shear-resisting shaped steel, the shear-resisting reinforced concrete block and etc.

The arrangement of the double-layer guideway structure of the invention is shown in FIG. 2. Because the clearance required for the train operation are not influenced by the double-layer guideway structure along the direction of height, the height of the main load-bearing girder may be freely determined in a certain range according to the requirements of structure span, the dynamic characteristics of the train system, etc. But along lateral direction, the lateral dimension of the main load-baring girder is limited to a certain degree by the clearance for the operation of the train system. In the case of track-bound transportation, the train system still has a high requirement on the guideway structure in the aspect of lateral rigidity. As for the main body structure of the separate mode of the invention, between respective lateral sides of each lower-layer main load-bearing girder are disposed the transversal supporting girders 11 at a certain interval, then the lateral rigidity of the guideway line structure may be greatly increased under the condition of without increasing its lateral dimension, the problem about the lateral rigidity of the guideway line structure for the high-speed guideway traffic is skillfully solved. According to the span of the structure and the material used for the structure, the main load-bearing girder of the main guideway may use different types of structure system, such as girder type, arch type and etc. As shown in the Figure, the electric-cable supporting brackets and the walkway for maintenance are respectively disposed at external side of the bottom portion of both main load-bearing girders of the main guideway body. This arrangement mode need not to increase the width of the main guideway body structure and has not any direct influences on the clearance of the train.

We claim:

1. A guideway structure for a high-speed track-bound transportation, comprising:

a longitudinally-extending lower-layer main load-bearing girder;

an upper-layer track surface structure, comprising:

a plurality of main body reinforced concrete plate girders arranged end-to-end in a longitudinal direction, and being disposed over said main load-bearing girder, a gap being provided between each adjacent plate girder to allow for expansion and contraction;

a plurality of longitudinally-extending steel elements defining gliding surfaces upon which a magnetic levitation train glides, and being respectively disposed on opposite lateral sides of said plate girders; and a plurality of connecting elements integrally attaching respective plate girders to respective steel elements; and a connection-mechanism that comprises supporting steel girders, weld nails, high strength bolts and steel bearing plates, said supporting steel girders being connected with the lower-layer main load-bearing girder by the high-strength bolts, and the steel bearing plates, the weld nails on a top of said supporting steel girders being deeply inserted into respective post-pouring holes on said reinforced concrete plate girders, wherein each of the reinforced concrete plate girders is supported by at least three of said supporting steel girders, including a rigid supporting steel girder disposed at a longitudinal intermediate portion of each respective reinforced concrete plate girder, and flexible supporting steel girders disposed respectively at each end of the respective reinforced concrete plate girder, wherein the rigid supporting steel girder has a plurality of longitudinal stiffening plates disposed thereon to increase its rigidity relative to said flexible supporting girders, wherein the flexible supporting steel girders are spaced apart from said rigid supporting steel girder, wherein said supporting steel girders raise said upper-layer track surface structure over said lower-layer main load-bearing girder so that there is a space therebetween, and wherein the lower-layer main load-bearing girder is connected to the upper-layer track-surface structure using the rigid supporting steel girders and the flexible supporting steel girders.

2. The guideway structure for high-speed track-bound transportation of claim 1, wherein the flexible supporting steel girder has a web plate disposed thereon.

3. The guideway structure for high-speed track-bound transportation of claim 1, wherein the guideway structure is a double-track guideway, and wherein between lateral surfaces of the lower-layer main load-bearing girders-of the respective guideway lines are disposed a series of supporting transversal girders.

4. The guideway structure for high-speed track-bound transportation of claim 3, wherein at an external side of each lower-layer main load-bearing girder are disposed electric-cable supporting brackets and a maintenance walkway.

5. A guideway structure for a high-speed track-bound transportation, comprising:

two parallel tracks, each comprising:

a lower-layer main load-bearing girder;

an upper-layer track-surface structure, comprising a plurality of longitudinally-extending main body reinforced concrete plate girders, arranged end-to-end with a gap therebetween; and a connection mechanism disposed over said load-bearing girder and under the track-surface structure, and connecting the track-surface structure to said load-bearing girder, said connection mechanism including supporting steel girders, each being connected to said upper-layer track-surface structure using weld nails, and connected to said lower-layer main load-bearing girder using high strength bolts;

wherein each of the reinforced concrete plate girders is supported by at least three of said supporting steel girders, including a rigid supporting steel girder disposed at a longitudinal intermediate portion of the respective reinforced concrete plate girder, and two flexible supporting steel girders disposed respectively at each end of the respective reinforced concrete plate girder;

wherein the rigid supporting steel girder has a plurality of longitudinal stiffening plates disposed thereon to increase its rigidity relative to the flexible supporting steel girders; and wherein the lower-layer main load-bearing girder is connected to the upper-layer track-surface structure using the rigid supporting steel girder and the flexible supporting steel girders.

6. The guideway structure recited in claim 5, further comprising laterally-extending supporting girders connecting said lower-layer main load-bearing girder of one of said parallel tracks to said lower-layer main load-bearing girder of another of said parallel tracks.

* * * * *